United States Patent [19]

Hodgins

[11] Patent Number: 4,672,911

[45] Date of Patent: Jun. 16, 1987

[54] CANOE SEAT AND OAR LOCK UNIT

[76] Inventor: Lorne H. Hodgins, 566 Cedar Street, Campbell River, British Columbia, Canada, V9W 5S5

[21] Appl. No.: 800,659

[22] Filed: Nov. 22, 1985

[30] Foreign Application Priority Data

Sep. 17, 1984 [CA] Canada ..... 463371

[51] Int. Cl.[4] ..... B63B 17/00

[52] U.S. Cl. ..... 114/363

[58] Field of Search ..... 114/343, 363, 364, 345, 114/39, 102; 440/104, 105; 441/40; 297/217, 281, 282

[56] References Cited

U.S. PATENT DOCUMENTS 441,534 11/1890 Chubb ..... 114/363
2,815,517 12/1957 Andresen ..... 114/364
3,656,445 4/1972 Padwick ..... 114/102
3,718,365 2/1973 Gibson ..... 114/363

FOREIGN PATENT DOCUMENTS 2938211 4/1981 Fed. Rep. of Germany ..... 440/104

*Primary Examiner*—Joseph F. Peters, Jr.
*Assistant Examiner*—Jesûs D. Sotelo
*Attorney, Agent, or Firm*—Stanley E. Johnson

[57] ABSTRACT

A combined seat and rowing device for a canoe which includes a U-shaped frame having the legs thereof interconnected by a cross-piece and clamps slidably mounted on such cross-piece to detachably mount the device on a canoe. The frame has two upwardly directed portions with an oar lock pivotally mounted on respective ones thereof. A sheet of flexible material traversing the frame provides a seat for the occupant and an optional backrest may be pivotally mounted on the frame.

11 Claims, 11 Drawing Figures

CANOE SEAT AND OAR LOCK UNIT

FIELD OF INVENTION

This invention relates to a combined seat and rowing device detachably mountable on a canoe.

BACKGROUND OF INVENTION

Various attempts have been made to attach oar locks and seats to a canoe in such manner that the oars may be readily used. One proposal is disclosed in U.S. Pat. No. 2,815,517, issued Dec. 10, 1957 to John H. Anderson. There is a problem, however, with the known devices in that they are not stable on the canoe during use as they are not designed properly to counteract the reactionary forces during rowing and/or require elaborate securing means.

The present invention is directed to improvements simplifying the structure, making it more readily adaptable to various different canoes and rendering it stable on the canoe during use.

SUMMARY OF INVENTION

The invention is particularly directed to a simplification in the frame structure and means for mounting the same on a canoe and a structure which may be variously adjusted to accommodate the users thereof.

The invention is particularly directed to an attachment for a canoe comprising a peripheral frame having a front and a rear cross member interconnected by respective ones of a pair of side members, a sheet of flexible material anchored at opposite ends respectively to said front and rear cross members providing a seat for an occupant, a pair of oar locks pivotally mounted on said frame and projecting upwardly therefrom, said oar locks being located at opposite sides of the frame in the vicinity of said front cross member and a pair of clamping units slidably mounted in spaced apart relation on said front cross member for attaching the device to the gunnels of a canoe.

LIST OF DRAWINGS

The invention is illustrated by way of example with reference to the accompanying drawings, wherein.

DESCRIPTION OF THE PREFERRED EMBODIMENT

Figure 1:
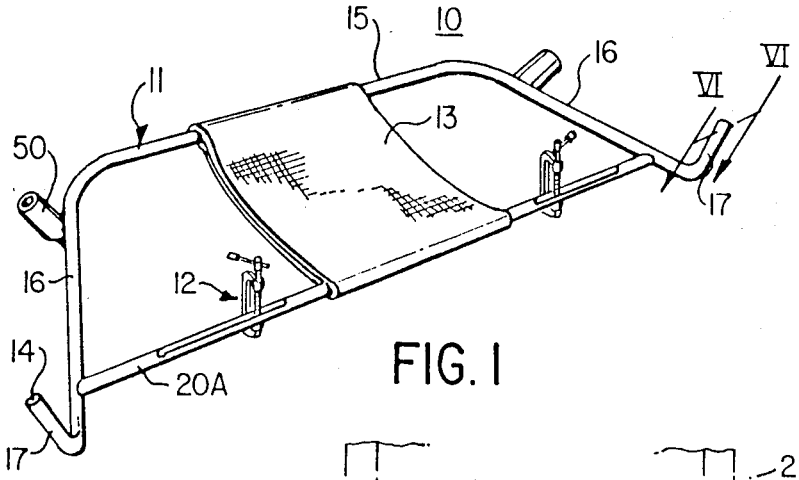
FIG. 1 is an oblique view of a rowing device provided in accordance with the present invention.
Figure 2:
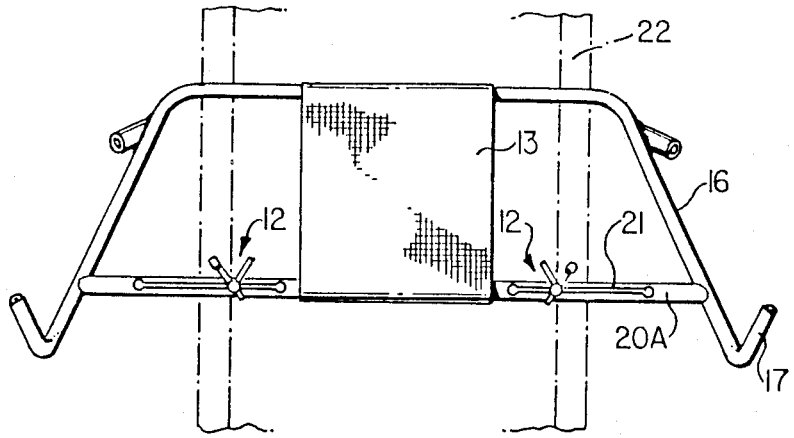
FIG. 2 is a top plan view of FIG. 1.
Figure 3:
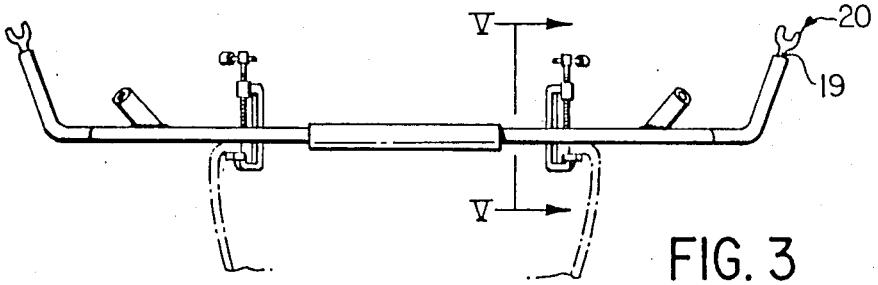
FIG. 3 is a front elevational view of FIG. 2.
Figure 4:
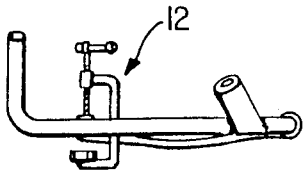
FIG. 4 is a right-hand side elevational view of FIG. 2.

Referring now to the drawings, there is illustrated in FIG. 1 a combined seat and rowing device 10 which includes a frame 11, adjustably mounted clamp means 12 for attaching the device to a canoe, a seat 13, and means 14 for pivotally mounting oar locks 20 on the frame.

Figure 6:
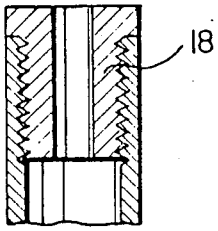
FIG. 6 is a partial cross-sectional view taken essentially along line 6—6 of FIG. 1.

The frame 11, made of light-weight tubular material, includes a U-shaped member having a rear portion 15 with a pair of forwardly projecting legs 16 turned upwardly at the outer end thereof as indicated at 17. The upwardly turned ends 17 (see FIG. 6) have bearing inserts 18 threaded (or press fit) thereinto for receiving the stem portion 19 of a common or standard oar lock unit 20. The frame is preferably made of aluminum and the inserts 18 of bronze or nylon to provide an appropriate bearing for oscillation of the oar locks. The legs 16 of the frame have a cross member 20 attached thereto rearwardly of the upwardly turned portion 17. The cross-member 20 and the rear member 15 of the frame rest upon the top of the canoe when in use and is securely anchored to the gunnels of the canoe by the clamp mechanisms 12. The clamp mechanisms 12 are standard C-clamps which can be slid longitudinally along cross-member 20. The C-clamps slide in a slot 21 in the cross-member thereby making the unit readily attachable to a range of sizes of canoes and also attachable whether the gunnels be located inwardly or outwardly of the canoe.

Figure 7:
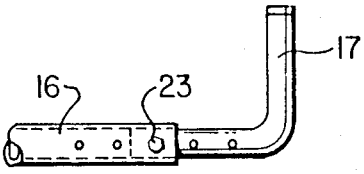
FIGS. 7 and 8 are partial elevational views illustrating means for variously adjusting the position for the oar lock on the frame.
Figure 8:
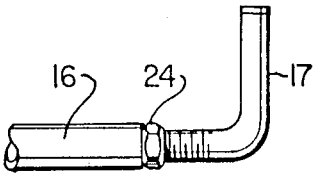

In order to make the unit adaptable to different occupants, the upwardly turned portion 17 of the frame may be adjustably mounted on the remaining portion of the frame in various different ways two of which are illustrated in FIGS. 7 and 8. In FIG. 7, the upwardly turned portion 17 is telescopically mounted in the frame portion 16 and locked at various different locations by way of a pin 23 which passes through aligned apertures in the respective frame portions 16 and 17. In the embodiment illustrated in FIG. 8, the upwardly turned portion 17 extends from a neck part (i.e. an L-shaped member), the neck part being threaded into the frame portion 16. A lock nut 24 is provided for holding the unit in its final set position.

Figure 5:
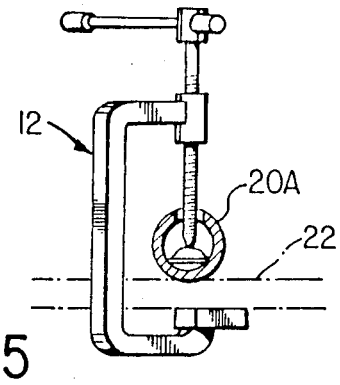
FIG. 5 is a view taken essentially along Section 5—5 of FIG. 3.

FIG. 5 illustrates in detail the anchoring clamps 12 which are standard C-clamps, one part of the clamping portion engaging the undersurface of the gunnel 22 and the other being located within the tubular member 20. The clamping portion within the tubular member is larger than the width of the slot which facilitates retaining the clamps on the frame during non-use.

Figure 9:
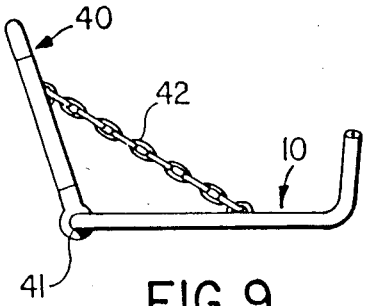
FIG. 9 is a side elevational view illustrating means of providing a back-rest.
Figure 10:
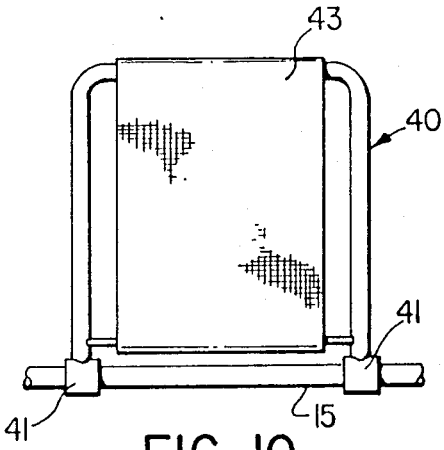
FIG. 10 is a partial front elevational view of FIG. 9.

FIGS. 9 and 10 illustrate a modified embodiment wherein the frame 10 (illustrated in FIG. 1) is provided with a back-rest 40, pivotally mounted as at 41 on the frame portion 11 and retained in an appropriate upright angular position relative to the seat by a pair of chains 42 that may be appropriately adjusted in length in any convenient manner. The back-rest is provided with a flexible covering 43. The back-rest material 43 and seat 13 are preferably of a rubberized canvas material that will withstand ultra-violet rays and outdoor use and with sufficient flexibility as to provide comfort for the user. The seat 13 is manufactured so as to be slightly loose on the frame, or alternatively, stretchable such that when the occupant is resting thereon the seat depresses downwardly placing the occupant's weight at the same position as would occur if the occupant were sitting on the normal seats in the canoe. In other words, the sheet of flexible material assumes a position offset from the plane of the frame.

Figure 11:
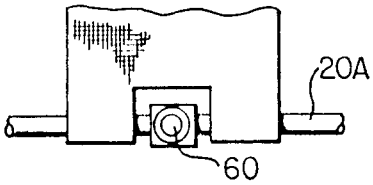
FIG. 11 is a partial top plan view illustrating means for mounting a mast assembly on the rowing device.

FIG. 11 illustrates a further embodiment wherein the frame portion 20 has a socket 60 pivotally (or, alternatively, rigidly) mounted thereon for receiving the lower end of a mast should the occupants desire to use a sail on the canoe. The socket can be readily supplied in a suitable shape and size to receive the universal joint mast mounting commonly used on sail boards which have become popular in recent years.

Figure 12:
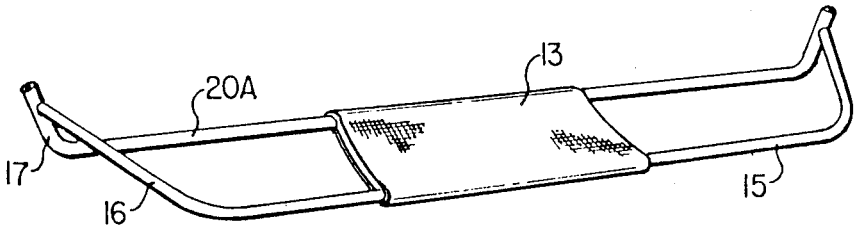
FIG. 12 is an oblique view of a further embodiment of the present invention.

The embodiment illustrated in FIG. 12 is essentially the same as that illustrated in FIG. 1 except that the frame-leg portions 16 are secured intermediate the ends of the upwardly projecting portions 17 on the cross member 20. Effectively, in this embodiment, the cross member 20 and upwardly directed projection 17 is a U-shaped member and with the remaining portion of the frame secured thereto is a second U-shaped member. The disadvantage of this embodiment is that the oar locks are located in a position closer to the seat which might be awkward for some rowers. The preferred position of the oar locks is forward of the cross bar 20.

In using a device construction as illustrated, it has been found that the U-shaped frame and attachment of the cross bar 20 to the canoe, reactionary forces resulting from use of the oars in the oar locks are counteracted in a favourable manner.

The frame 10 is provided with a pair of sockets 50 which are tubular members sloping upwardly and outwardly. These tubular members are provided for receiving the handle end portion of fishing rods.

What is claimed:

1. An attachment for a canoe comprising a peripheral frame having a front and a rear cross-member interconnected by respective ones of a pair of side members, a sheet of flexible material anchored at opposite ends respectively to said front and rear cross-members providing a seat for an occupant, a pair of oar lock mounting members selectively adjustably mounted on said frame for pivotally receiving respective ones of a pair of oar locks, said oar lock mounting members being located at opposite sides of the frame and adjustably movable relative to said front cross member and a pair of clamping units slidably mounted in spaced apart relation on said front cross member for attaching the device to the gunnels of a canoe.

2. A canoe attachment as defined in claim 1 wherein said front and side members are in a common plane.

3. A canoe attachment as defined in claim 1 wherein said side members and said rear cross-member is formed from a single length of tubular material bent into a U-shape.

4. A canoe attachment as defined in claim 1 wherein said oar lock mounting members are located forwardly of said front cross-member and adjustably movable in a direction toward and away therefrom.

5. A canoe attachment as defined in claim 4 wherein said oar lock mounting members are L-shaped and telescopically mounted on said frame.

6. A canoe attachment as defined in claim 1 including a backrest pivotally mounted on said rear cross-member and means for selectively adjusting the angular position of said backrest with respect to said seat.

7. A canoe attachment as defined in claim 6 wherein said backrest includes a metal tube bent into a U-shape and having a sheet of flexible material traversing the same providing the backrest.

8. A canoe attachment as defined in claim 1 including a socket mounted on said front cross-member for receiving an end portion of a mast for a sail.

9. A canoe attachment as defined in claim 8 wherein said socket is pivotally mounted on said front cross-member.

10. A canoe attachment as defined in claim 1 wherein said peripheral frame comprises a first tubular member bent into the shape of U with the free outer end portions thereof turned upwardly for mounting the oar locks thereon and a second tubular member interconnecting the legs of the U at a position spaced from the upwardly turned end portions, said clamping units being slidably mounted on said second member.

11. A combined seat and rowing device for a canoe comprising a generally U-shaped frame portion having generally L-shaped oar mounting members adjustably mounted thereon and providing upwardly turned outer free ends, an oar lock pivotally mounted on respective ones of the upwardly turned ends, a cross-member interconnecting the legs of the U-shaped frame, a sheet of flexible material extending across said frame and anchored thereto providing a seat for an occupant, and a pair of clamping units slidably mounted on said cross member for attaching the device to the gunnels of a canoe, said U-shaped frame portion and cross-member lying in a common plane.

* * * * *